US005715885A

United States Patent [19]

Nagarwalla et al.

[11] Patent Number: 5,715,885

[45] Date of Patent: Feb. 10, 1998

[54] APPARATUS AND METHOD FOR CLEANING CORE BOX VENTS

[75] Inventors: Pheroze J. Nagarwalla, St. Charles; Raymond F. Witte, Naperville, both of Ill.

[73] Assignee: Georg Fischer Disa, Inc., Oswego, Ill.

[21] Appl. No.: 581,457

[22] Filed: Dec. 29, 1995

[51] Int. Cl.[6] ..... B22C 7/06; B22C 9/10

[52] U.S. Cl. ..... 164/20; 164/21; 164/158; 164/186; 164/228; 164/234

[58] Field of Search ..... 164/158, 228, 164/234, 200, 201, 12, 16, 19, 20, 21, 22, 186

[56] References Cited

U.S. PATENT DOCUMENTS

| | | | |
|---|---|---|---|
| 2,238,506 | 4/1941 | Rienacker . | |
| 2,482,330 | 9/1949 | Dudzinski . | |
| 3,188,701 | 6/1965 | McIntyre . | |
| 3,214,803 | 11/1965 | Arnt . | |
| 3,529,656 | 9/1970 | Levy | 164/234 |
| 3,602,293 | 8/1971 | Barrett | 164/410 |
| 3,631,918 | 1/1972 | Barrett | 164/410 |
| 4,390,056 | 6/1983 | Grove et al. | 164/7.1 |
| 5,115,856 | 5/1992 | Downing et al. | 164/234 |
| 5,360,049 | 11/1994 | Rowe | 164/16 |
| 5,522,447 | 6/1996 | Sandstrom et al. | 164/228 X |

FOREIGN PATENT DOCUMENTS

| | | | |
|---|---|---|---|
| 35 05 000 | 8/1986 | Germany . | |
| 43 27 041 | 6/1994 | Germany . | |
| 47-14270 | 4/1972 | Japan | 164/158 |
| 58-205648 | 11/1983 | Japan | 164/158 |
| 531628 | 12/1976 | U.S.S.R. | 164/228 |
| 1050807 | 10/1983 | U.S.S.R. | 164/228 |
| 1058705 | 12/1983 | U.S.S.R. | 164/228 |
| 1197768 | 12/1985 | U.S.S.R. . | |

OTHER PUBLICATIONS

J. Truchelut, "Use of the Cold Box Process at Pont-A--Mousson", 6 pages, Publication Title Unknown, Publication Date Unknown, Admitted Prior Art.

*Primary Examiner*—J. Reed Batten, Jr.

*Attorney, Agent, or Firm*—Marshall, O'Toole, Gerstein, Murray & Borun

[57] ABSTRACT

The core box includes a cavity therein, a vent in fluid communication with the cavity, ejector members, and apparatus coupled to the ejector members for passing a fluid through the vent into the cavity.

20 Claims, 17 Drawing Sheets

APPARATUS AND METHOD FOR CLEANING CORE BOX VENTS

TECHNICAL FIELD

The present invention is directed generally to core boxes, and more particularly to a method and apparatus for cleaning core box vents.

BACKGROUND ART

In the foundry industry, sand cores are used to create voids in cast parts. Sand cores are produced by delivering core sand from a blow head or an extruding head into cavities in a core box. In order for the blow head or extruding head to completely fill the cavities in the core box, it is necessary to provide one or more vents to allow gases in the cavities to escape. Often the vents become clogged by sand and dust and thus become ineffective to allow gas to escape. Clogging can become pronounced after as few as 40 machine cycles. The location of the vents in the core boxes and the shape of the vents are among the variables affecting the number of machine cycles before clogging.

The efficiency of core production has been hindered by conventional vent cleaning methods and apparatus. One conventional method of unclogging vents is to remove the vents from the core box and clean the vents manually by brushing. This method is inefficient because the machine has to be stopped periodically to remove the vents from the core box for cleaning. Also, in between cleanings, the quality of the cores degrades as more machine cycles are performed.

In one approach to cleaning vents, air hoses are used to force air through the core box in the same (or forward) direction that the core sand was blown in. This approach is limited in effectiveness because vents, which are designed to prevent sand from escaping the core box in the forward direction while allowing gases to escape, do not readily release sand in the forward direction.

Another approach to cleaning vents has been to use air hoses extending through the stool of the core box to force air in a reverse direction through the vents. Although faster than manual cleaning and more effective than blowing air in the forward direction through the vents, this approach is limited in effectiveness because the inner structure of most core boxes prevents the air hoses from having close access to the vents. Also, air pressure under the drag can undesirably lift the core box above the surface supporting the core box.

Still another approach has been to modify vent designs in order to facilitate the removal of dust and sand therefrom. This approach has only met with limited success, however, owing to the fact that vents are supposed to trap and thereby prevent sand from leaving the core box while allowing gases to pass through.

SUMMARY OF THE INVENTION

The above-described problems with the prior art methods and apparatus are overcome by methods and apparatus in accordance with the present invention wherein core box vents can be cleaned without halting the production of cores.

More particularly, a core box in accordance with the present invention includes a core box portion having a cavity therein and a vent in fluid communication with the cavity. A plurality of ejector members extend into the core box portion and means coupled to the ejector members is provided for passing a fluid through the vent into the cavity.

The passing means may comprise a movable integral fluid manifold having an upper portion which carries the ejector members. The passing means may alternatively comprise a manifold plate movable into engagement with a manifold seal carried by the core box portion.

Still further, the passing means may instead include a fluid manifold carried by the core box portion and means movable into engagement with the fluid manifold for distributing fluid thereto. In a preferred embodiment, the distributing means comprises a plug plate carrying the ejector members and having a plurality of plugs engageable with ports in the fluid manifold. One of the plugs includes a passage therethrough from a fluid inlet to a fluid outlet.

In accordance with a further alternative embodiment, the passing means comprises a manifold cap member which carries the ejector members and is adapted to be engaged by an ejector plate to form a fluid manifold.

In accordance with a further aspect of the present invention, a core making machine comprises a core box having a drag including a bottom portion, a core cavity portion defined by the drag, and a vent disposed in the drag in fluid communication with the core cavity portion. The core making machine further includes an ejector member disposed below the drag and having a passage for passing fluid through the vent.

A further aspect of the present invention comprises a method of cleaning core box vents in a core making machine including an ejector member and a core box having a drag. The method includes the steps of providing a passage for passing fluid through the ejector member and passing fluid through the ejector member passage and the vent during ejection of a core.

The foregoing and other advantages of the invention will appear more fully hereinafter from a consideration of the detailed description which follows taken together with the accompanying drawings. It is to be expressly understood, however, that the drawings are for illustration purposes only and are not to be construed as defining the limits of the invention, reference being had to the appended claims for that purpose. In the drawings, like reference numerals refer to like elements.

DESCRIPTION OF THE PREFERRED EMBODIMENTS

Figure 1:
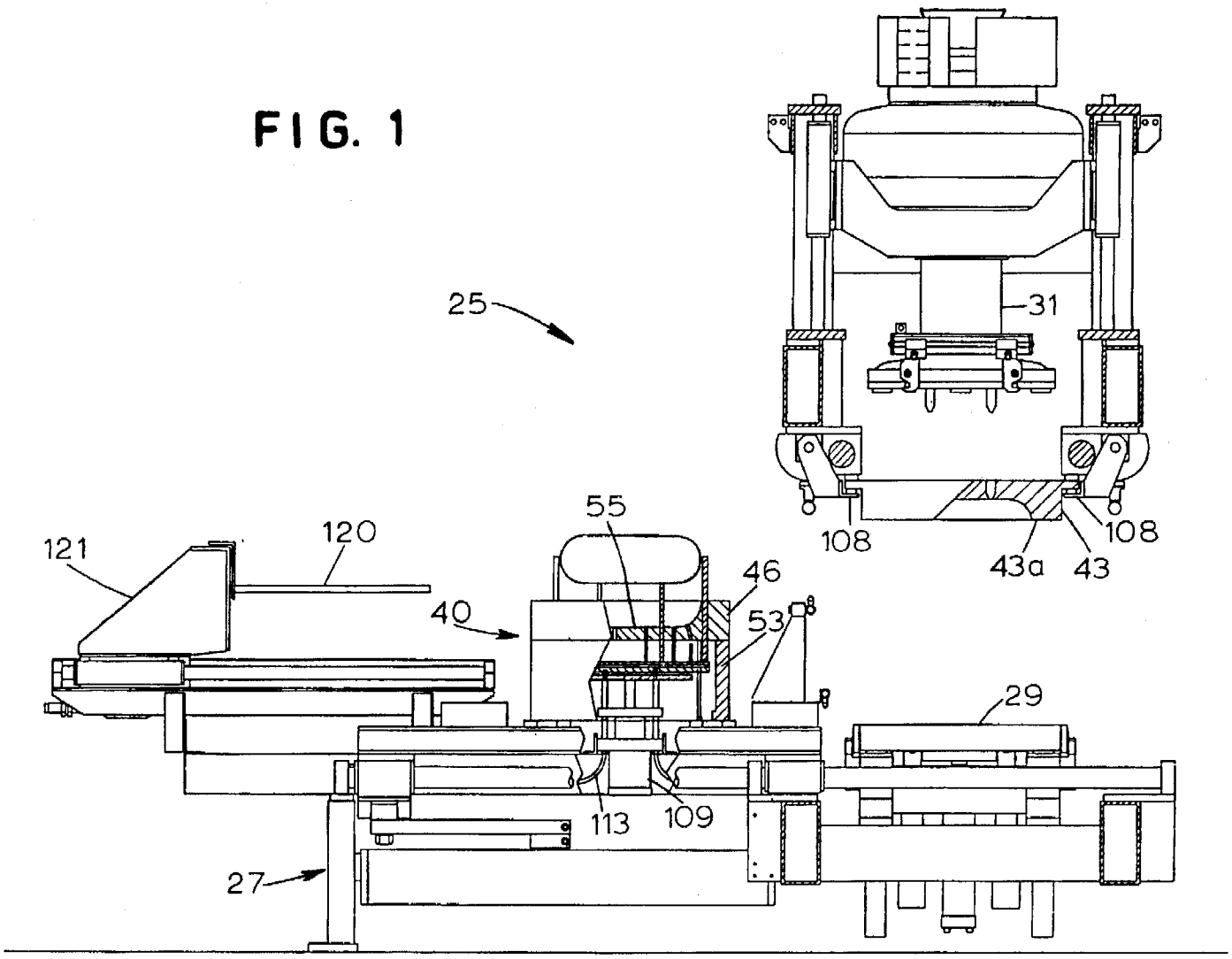
FIG. 1 comprises a sectional view of a core making machine accommodating a core box in accordance with the present invention with portions broken away to show hidden detail.

Referring initially to FIG. 1, a core making machine indicated generally at 25 is shown. The core making machine 25 comprises a shuttle 27, a ram 29, and an injection head 31 disposed above the ram 29 for injecting core sand.

Figure 2:
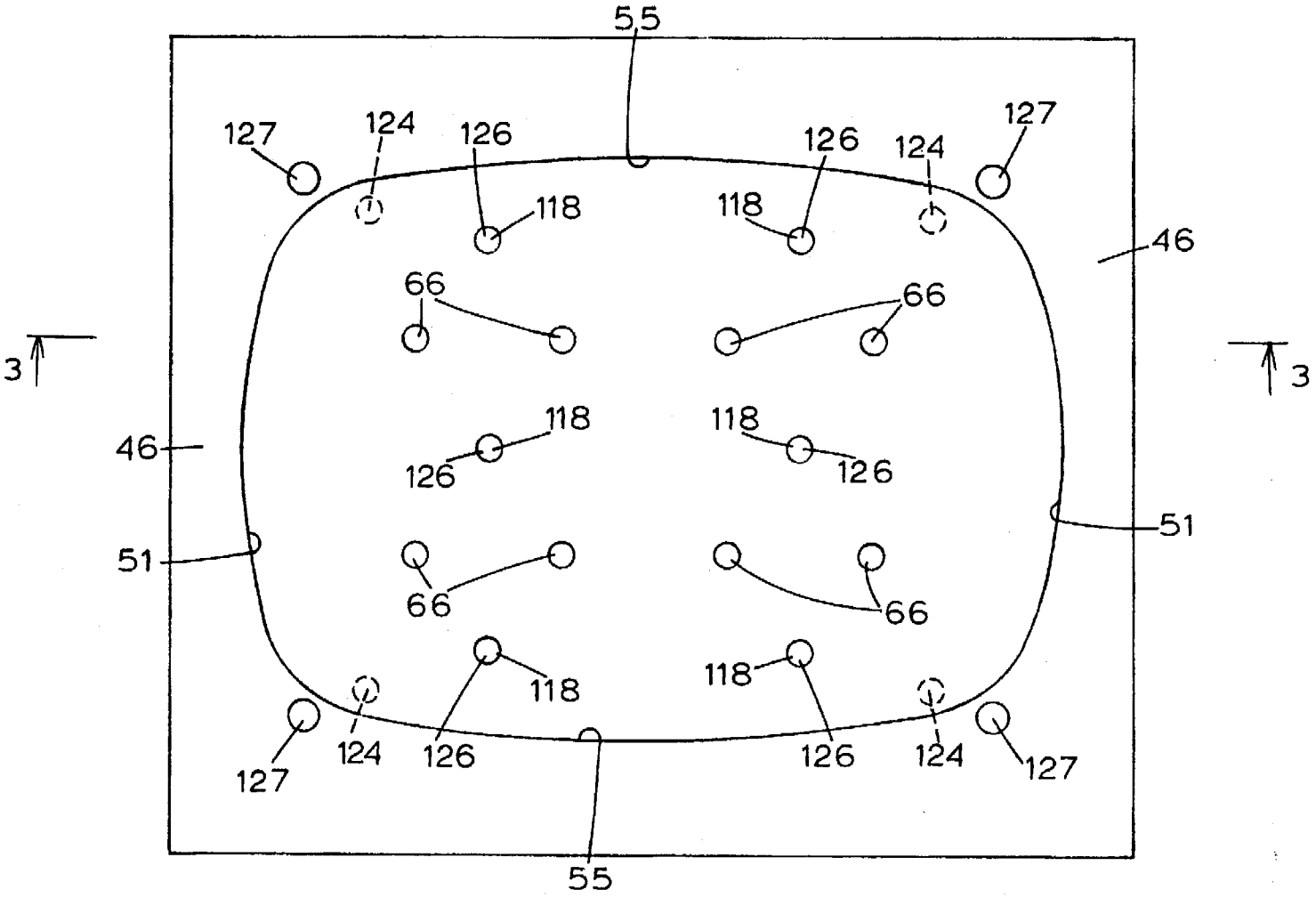
FIG. 2 comprises a plan view of a drag according to the present invention with the cope removed therefrom.
Figure 3:
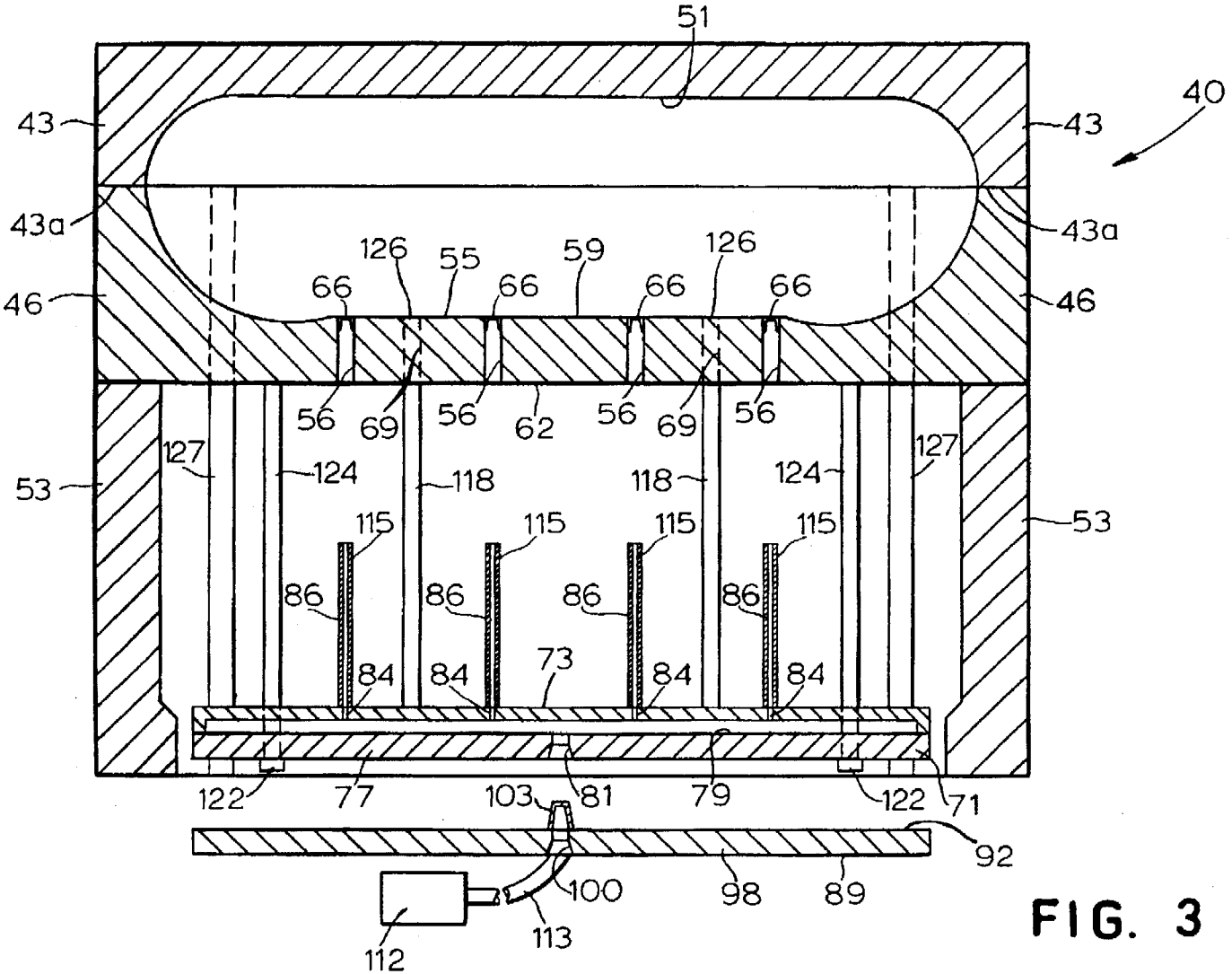
FIG. 3 comprises a sectional view of the drag taken generally along the lines 3—3 of FIG. 2 with a cope disposed thereon and with the core omitted therefrom for ease in understanding.
Figure 4:
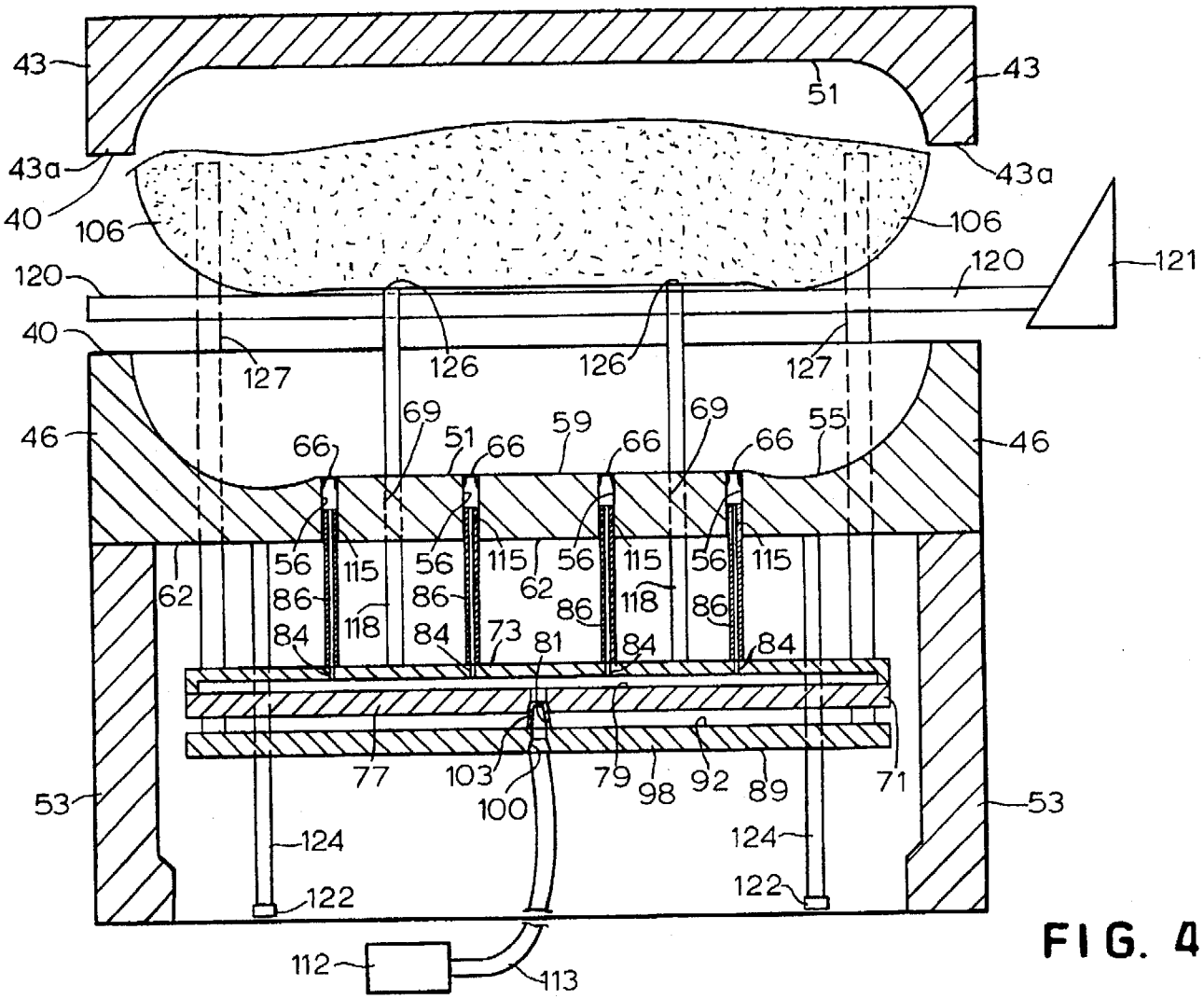
FIG. 4 comprises a view similar to FIG. 3 illustrating the drag after ejection of a core therefrom.

Referring also to FIGS. 2–4, the core making machine 25 of FIG. 1 accommodates a core box, indicated generally at 40, comprising a top half or cope 43, a bottom half or drag 46, a core cavity 51 therebetween, and a stool 53 below the drag 46. The drag 46 has a core cavity portion 55 and a plurality of passages 56 extending from a surface 59 of the drag 46 to a bottom 62 of the drag 46. One or more vents 66 are disposed in the passages 56 adjacent the surface 59 of the drag 46. The drag 46 also has a plurality of holes 69 extending from the surface 59 of the drag 46 to the bottom 62 of the drag 46. FIG. 2 shows the positions of the vents 66 in a horizontal plane.

The vents 66 may comprise fine screens inserted into and retained within the passages 56 by any known means. If desired, the vents 66 may comprise any other device for allowing gases within the cavity to escape while preventing escape of substantial amounts of sand therefrom.

A movable integral fluid manifold 71 is provided for passing a fluid, such as compressed air, or a mixture of compressed air and one or more solvents, through the vents 66 into the core cavity portion 55. The fluid manifold 71 has a top portion 73, a bottom portion 77, and a cavity 79 therebetween. One or more inlets 81 in the bottom portion 77 are in fluid communication with a plurality of outlets 84 in the top portion 73. A plurality of tubes 86 are attached by any suitable means, such as welds or by threads, to the top portion 73 of the fluid manifold 71 and extend toward the vents 66. Each tube 86 is in fluid communication with one outlet 84.

After core material has been injected into the core cavity 51 to produce a core 106, the ram 29 lowers and the shuttle 27 (FIG. 1) moves the core box 40 (without the cope 43) to an ejector position above an ejector plate 89.

The ejector plate 89 has a top surface 92, a bottom surface 98, and a passage 100 from the bottom surface 98 to the top surface 92. A fluid conduit comprising a nipple 103 is attached by any suitable means to the top surface 92 coaxially with the passage 100. When the ejector plate 89 is in a down position (FIG. 3), the ejector plate 89 is located below the core box 40.

It should be noted that while the cope 43 is shown in FIGS. 3 and 4, in reality such structure is not disposed on the drag 46 when the drag 46 is located above the ejector plate 89. At such a time, the cope 43 is retained by clamps 108 of the core making machine 25, as seen in FIG. 1.

Once the core box 40 is in the ejector position, the ejector plate 89 is raised from the down position by a hydraulic cylinder 109 (FIG. 1) or other lifting apparatus. While the ejector plate 89 is being raised, an air compressor 112 or other fluid pumping apparatus pumps cleaning fluid through a hose 113 connected to the ejector plate 89. Fluid then passes through the passage 100 of the ejector plate 89 and the fluid line 103. At this point, some cleaning fluid may pass through the fluid manifold 71, and some may further pass through the vents 66.

Eventually, as shown in FIG. 4, the nipple 103 attached to the top surface 92 of the ejector plate 89 engages the inlet 81 in the bottom portion 77 of the fluid manifold 71. The fluid manifold 71 is thereafter urged upwardly by the ejector plate 89. Also, the cleaning fluid pumped through the passage 100 of the ejector plate 89 passes directly into the inlet 81 of the fluid manifold 71 and through the tubes 86.

As the fluid manifold 71 moves upwardly toward the vents 66, top portions 115 of the tubes 86 enter the passages 56 located below the vents 66 in the drag 46. At this point, the fluid flowing out of the tubes 86 is directed toward the vents 66. The full direct flow of the cleaning fluid passes through the vents 66 in the reverse direction (i.e., in the direction opposite the direction at which the core sand was trapped by the vents 66), thereby removing sand and dust.

As the fluid manifold 71 continues to move upwardly toward the vents 66, ejector pins 118 attached to the top portion 73 of the fluid manifold 71 pass through the holes 69 in the bottom of the drag 46 and lift the core 106 above the drag 46. When the core 106 has been lifted high enough above the drag 46 to enable fingers 120 of finger pick offs 121 to remove the core 106 from the ejector pins 118, the hydraulic cylinder 109 stops lifting the ejector plate 89.

Cleaning fluid continues to be pumped by the air compressor 112 while the fingers 120 remove the core 106 from the ejector pins 118 and while the ejector plate 89 is subsequently lowered back to the down position below the core box 40. As the ejector plate 89 is lowered, the nipple 103 of the ejector plate 89 disengages from the fluid manifold 71. The downward movement of the fluid manifold 71 is stopped when the bottom portion 77 of the fluid manifold 71 contacts heads 122 of stop pins 124 which are threaded into or otherwise secured to the drag 46. In embodiments in which the fluid manifold 71 has bores for accommodating the stop pins 124, seals may be carried by the fluid manifold 71 surrounding each of the stop pins 124 and disposed in contact therewith to prevent loss of fluid pressure.

It should be noted that the ejector plate 89 is either of a dimension that does not interfere with the stop pins 124 or includes bores or holes through which the stop pins 124 extend as the ejector plate 89 is raised.

Preferably, each of the ejector pins 118 is of a length which results in a top surface 126 being located just at or below the surface 59 of the drag 46 when the bottom portion 77 of the fluid manifold 71 is resting on the heads 122 of the stop pins 124.

Also preferably, the fluid manifold 71 includes control pins 127 secured in any suitable fashion to the top portion 73 that extend to the top of the drag 46 into contact with a lower mating surface 43*b* (FIGS. 3 and 4) of the cope 43 when the fluid manifold 71 is in the down position (FIG. 3). The relative positions of the control pins 127 and the stop pins 124, in a plane perpendicular to the axes of such pins, is shown in FIG. 2. The control pins 127 push the ejector plate 89 down so that the ejector pins 118 do not extend into the core cavity 51 during injection of core sand. In this fashion, the ejector pins 118 do not interfere with formation of cores in the core cavity 51.

If desired, cleaning fluid need not be pumped during the entire raising and lowering cycle of the ejector plate 89. For example, the pumping of fluid may be controlled so that fluid is only pumped while the nipple 103 of the ejector plate 89 is engaged in the fluid manifold 71. If the cleaning fluid contains solvent, the core 106 should be raised above the surface 59 of the drag 46 prior to pumping of cleaning fluid. Thus, in such a circumstance, cleaning fluid is preferably pumped only while the top portions 115 of the tubes 86 are in the passages 56.

In an alternative embodiment (not shown), the tubes 86 may be omitted and fluid exits the outlets 84 in the fluid manifold 71 without further guidance toward the passages 56 in the drag 46. Some of the fluid passes through the vents 66 into the core cavity portion 55, removing sand and dust.

Figure 5:
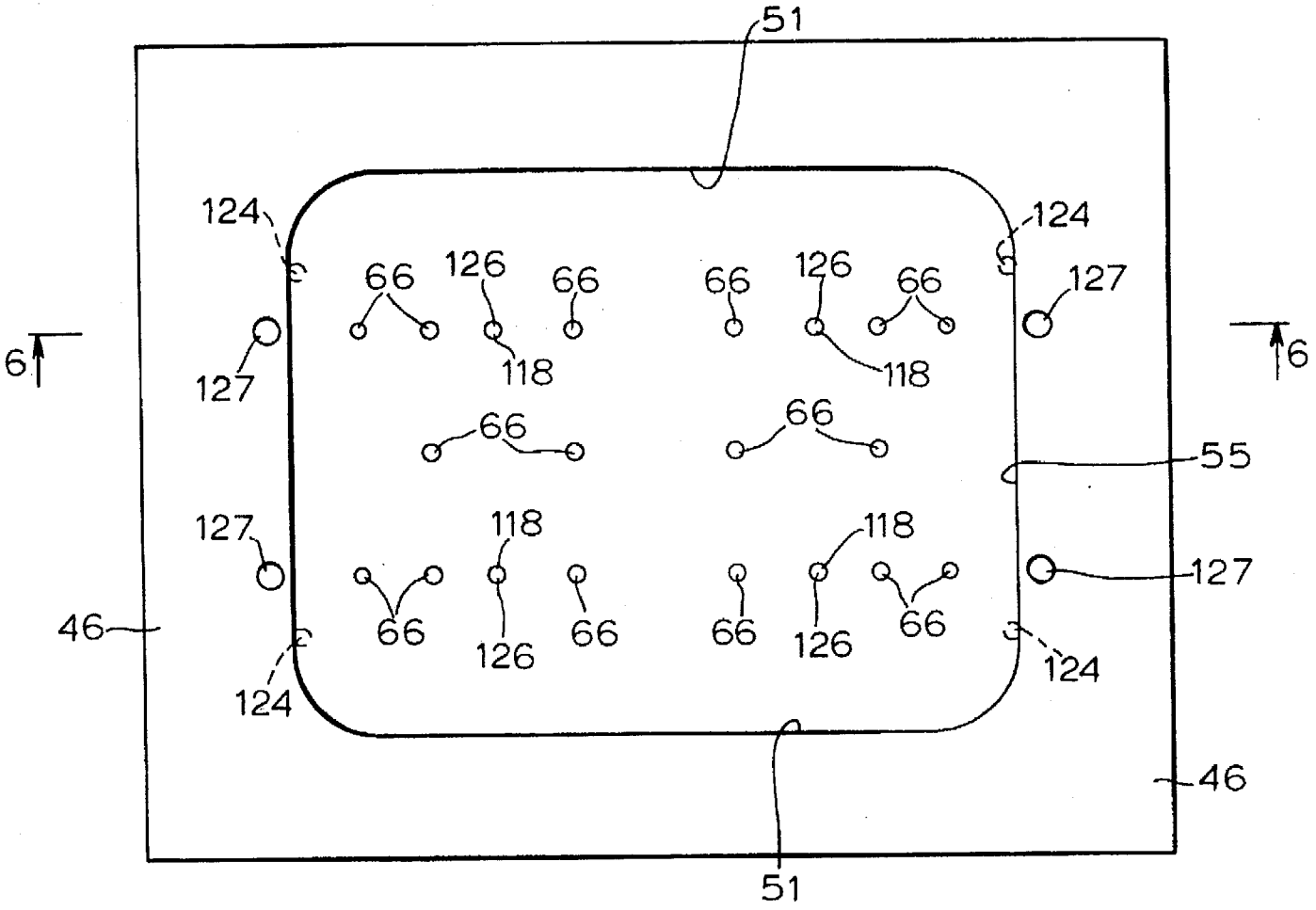
FIG. 5 comprises a plan view of a drag of a second embodiment of the present invention with the cope removed therefrom.
Figure 6:
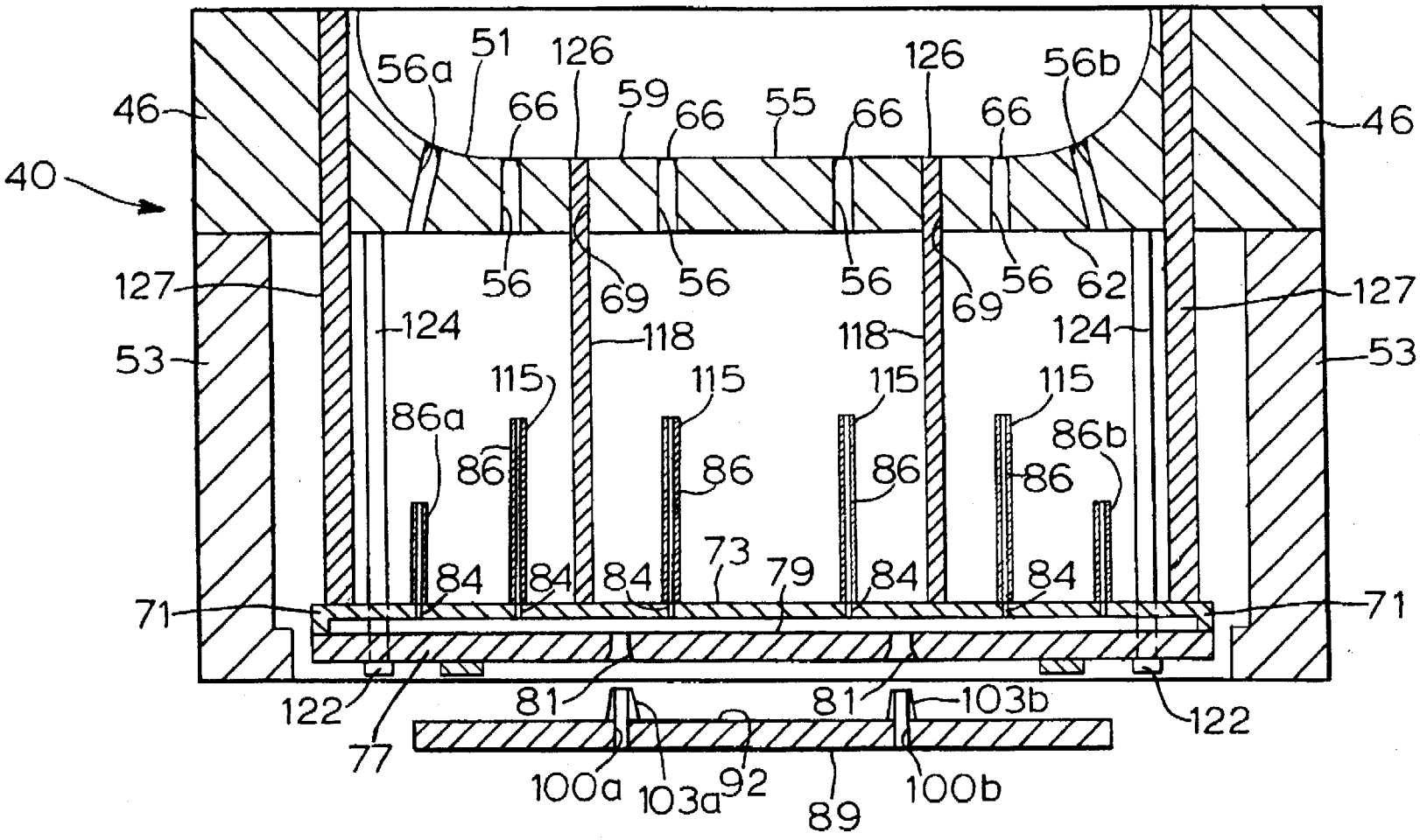
FIG. 6 comprises a sectional view of the drag taken generally along the lines 6—6 of FIG. 5 with the core omitted therefrom for ease in understanding.
Figure 7:
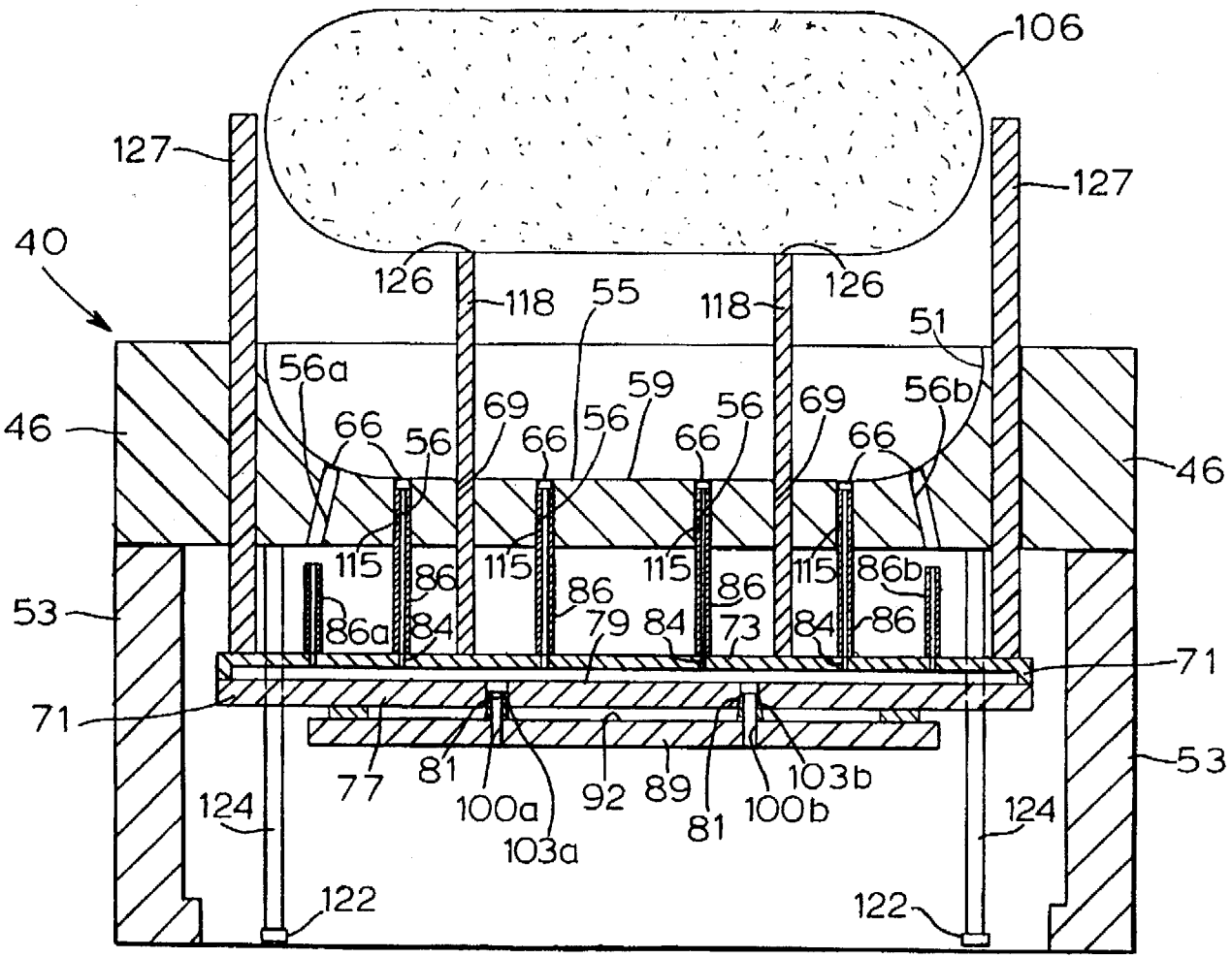
FIG. 7 comprises a view similar to FIG. 6 illustrating the drag after ejection of a core therefrom.

FIGS. 5–7 illustrate a modification to the embodiment of FIGS. 2–4 wherein a different number of passages 56 and vents 66 are provided and wherein each passage 56 receives an associated tube 86 when the fluid manifold 71 is raised. In this embodiment, not all of the passages 56 are parallel to one another (see outer passages 56*a*, 56*b*). Because of this, relatively short outer tubes 86*a*, 86*b* must be used that are located below or only just enter the associated passages 56*a*, 56*b* when the formed core is fully ejected.

The embodiment of FIGS. 5–7 also differs from that shown in FIGS. 2–4 in the use of two nipples 103*a*, 103*b* in fluid communication with passages 100*a*, 100*b*, as opposed to the single passage/nipple combination 100, 103. The passages 100*a*, 100*b* may be coupled to a single source of fluid, such as the air compressor 112, or to separate sources of cleaning fluid, such as multiple air compressors. In fact, any number of passage/nipple combinations may be used in conjunction with any number of cleaning fluid sources, as desired, in any of the embodiments disclosed herein.

Figure 8:
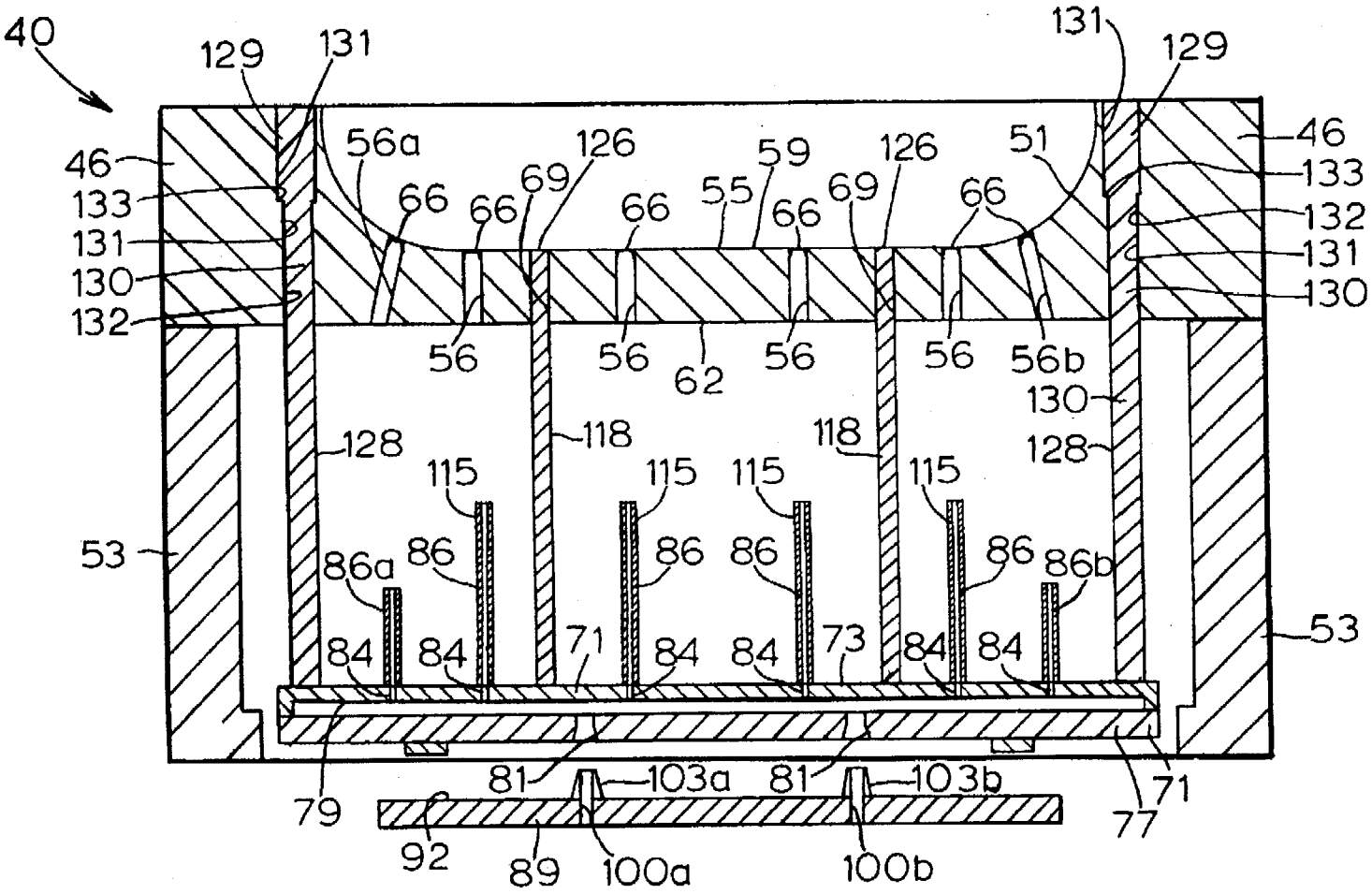
FIGS. 8 and 9 comprise views similar to FIGS. 6 and 7, respectively, of a third embodiment of the present invention.
Figure 9:
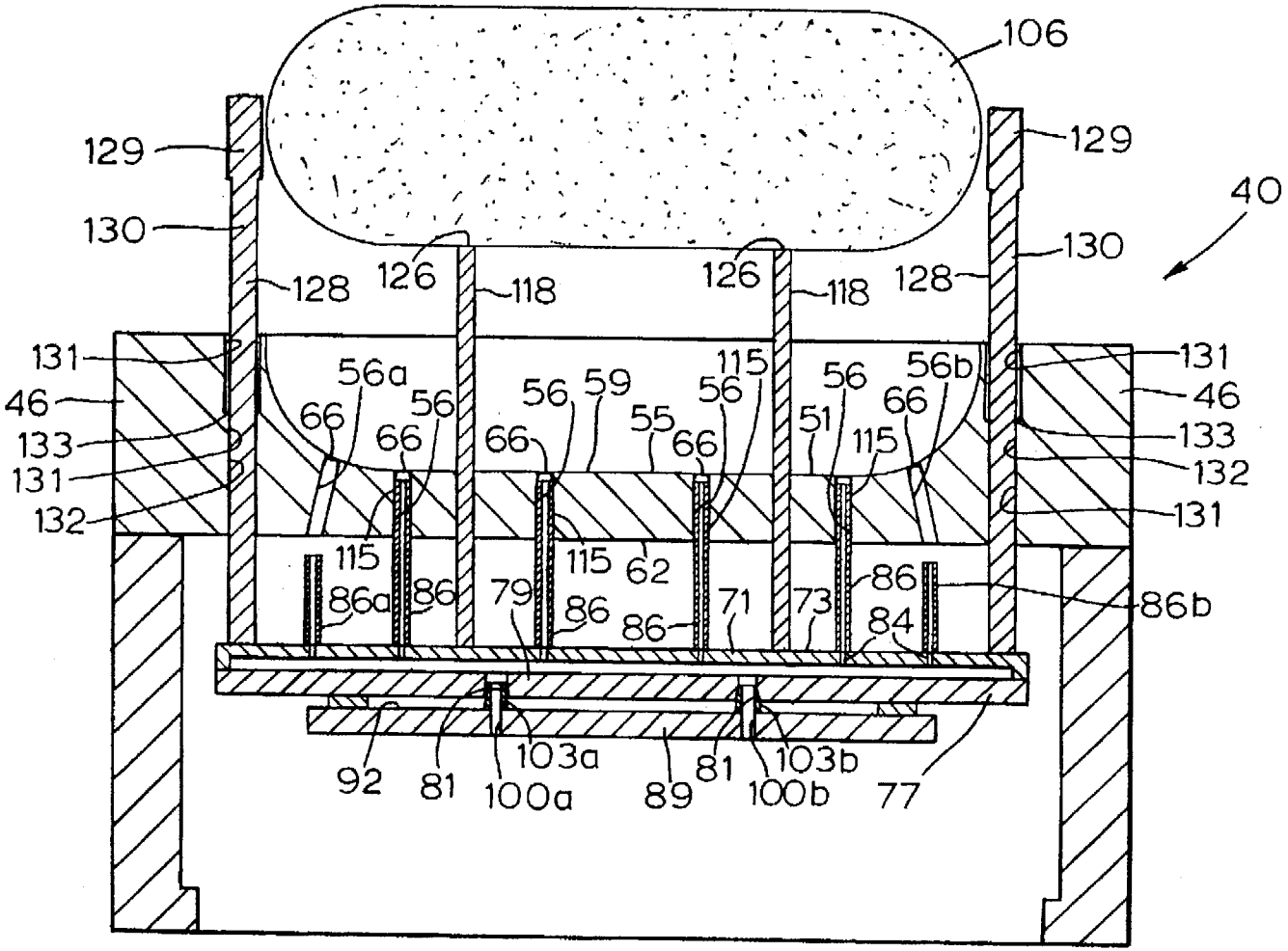

Referring now to FIGS. 8 and 9, a plurality of control pins 128, similar to the control pins 127, are secured by any suitable means to the fluid manifold 71 and may also function as stop pins. The control pins 128 have a wide upper portion 129 and a lower portion 130 narrower than the wide upper portion 129. The upper portion 129 of each control pin 128 is disposed in an associated passage 131 in the drag 46. Each passage 131 includes a section 132 which is narrower than the upper portion 129 of the control pine 128. As the fluid manifold 71 attached to the control pins 128 is lowered after ejection of the core 106, the upper portions 129 of the control pins 128 eventually abut shoulders 133 and are stopped, together with the fluid manifold 71, the tubes 86 and the pins 118, from further downward movement.

Figure 10:
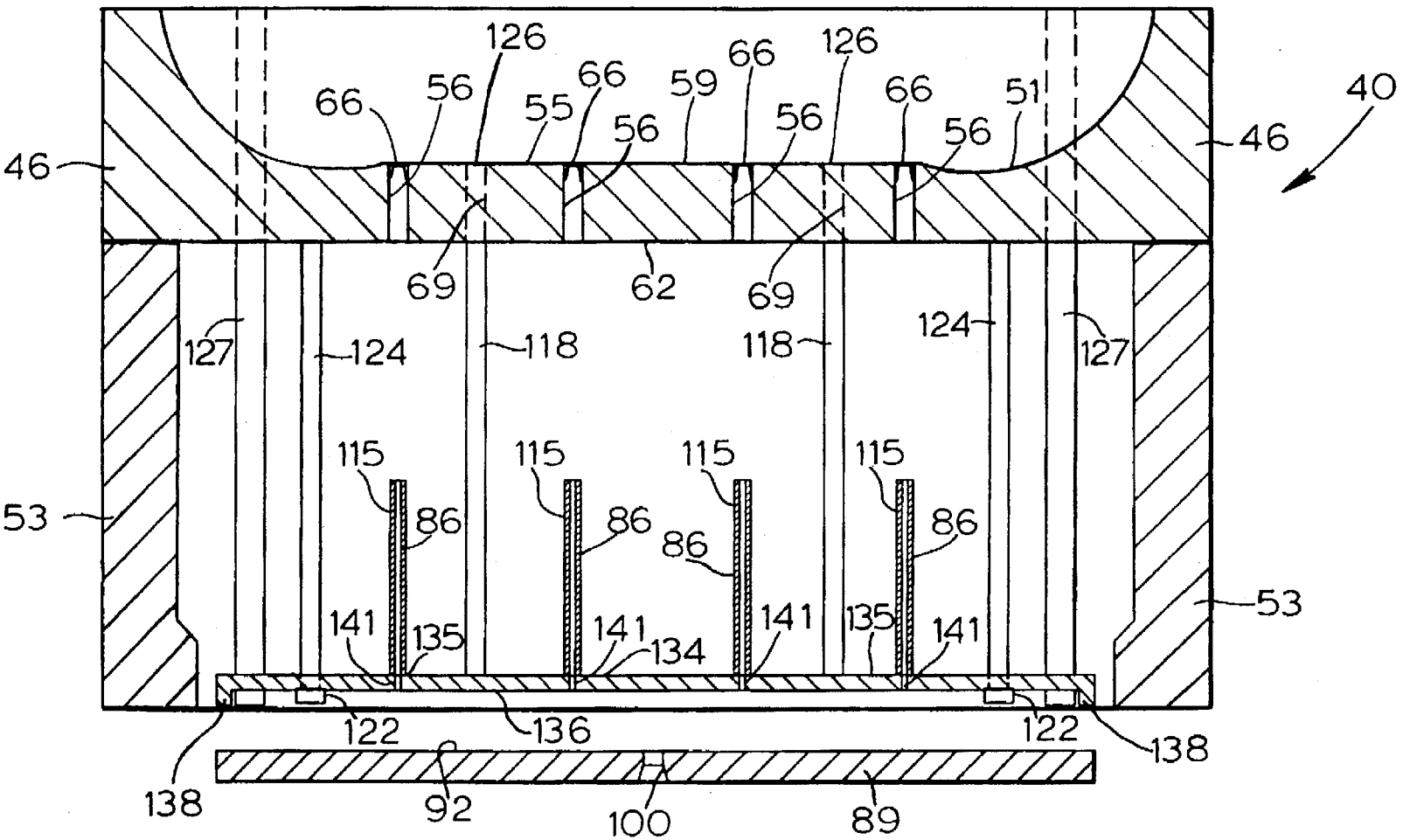
FIGS. 10 and 11 comprise views similar to FIGS. 3, 6 and 7, respectively, of a fourth embodiment of the present invention.
Figure 11:
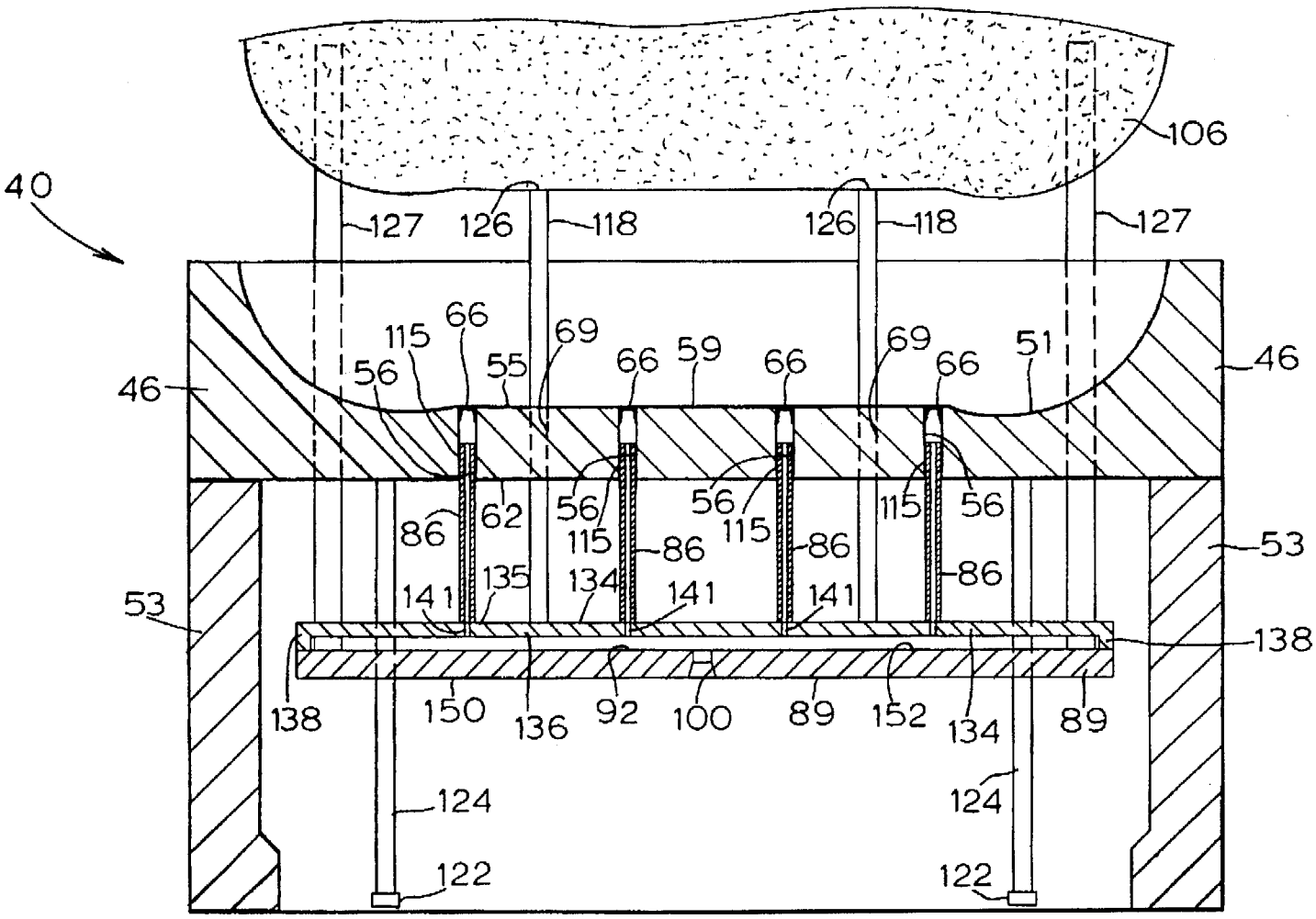

In a further alternative embodiment, shown in FIGS. 10 and 11, the single-piece manifold 71 is replaced by a movable manifold cap 134 having a top surface 135 facing the drag 46, a bottom surface 136, a marginal flange or lip 138 extending from the bottom surface 136, and a plurality of apertures 141. The ejector pins 118 and the tubes 86 are secured in any suitable fashion to the top surface 135 of the manifold cap 134. Each tube 86 is in fluid communication with one of the apertures 141.

After core material has been injected into the core cavity 51 to produce the core 106, the core box 40 (without the cope 43) is shuttled to a location above the ejector plate 89, as described previously. The ejector plate 89 is then raised from the down position (FIG. 10) by the hydraulic cylinder 109 (FIG. 1) toward the manifold cap 134.

Eventually, the ejector plate 89 contacts the lip 138 of the manifold cap 134, thereby producing a seal that forms a fluid manifold 150 having a cavity 152, as shown in FIG. 11. Thereafter, the embodiment of FIGS. 10 and 11 operates in the same fashion as the embodiment of FIGS. 3 and 4 except that the ejector plate 89 separates from the manifold cap 134 during movement to the down position and the manifold cap 134 engages the heads 122 of the stop pins 124. Further, seals may be provided on the manifold cap 134 and the ejector plate 89 where the stop pins 124 extend through such structures to prevent loss of cleaning fluid at the interfaces between such structures.

As in the preceding embodiments, cleaning fluid need not be pumped during the entire raising and lowering cycle of the ejector plate 89. For example, one may begin pumping cleaning fluid through the ejector plate 89 when the ejector plate 89 is sealed to the lip 138 of the manifold cap 134 and stop pumping when, during lowering of the ejector plate 89, the seal is broken.

Figure 12:
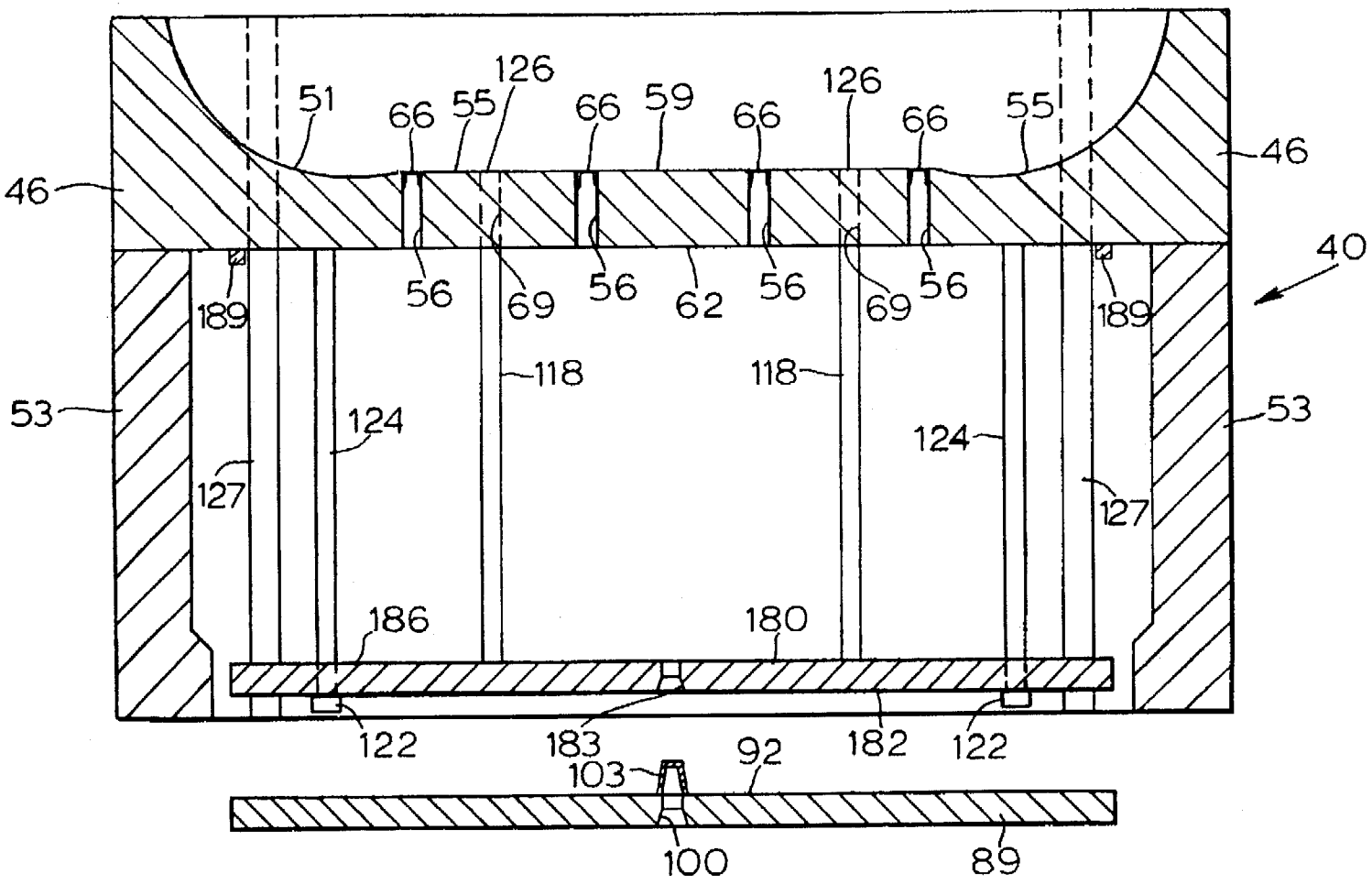
FIGS. 12 and 13 comprise views similar to FIGS. 11, 6 and 7, respectively, of a fifth embodiment of the present invention.
Figure 13:
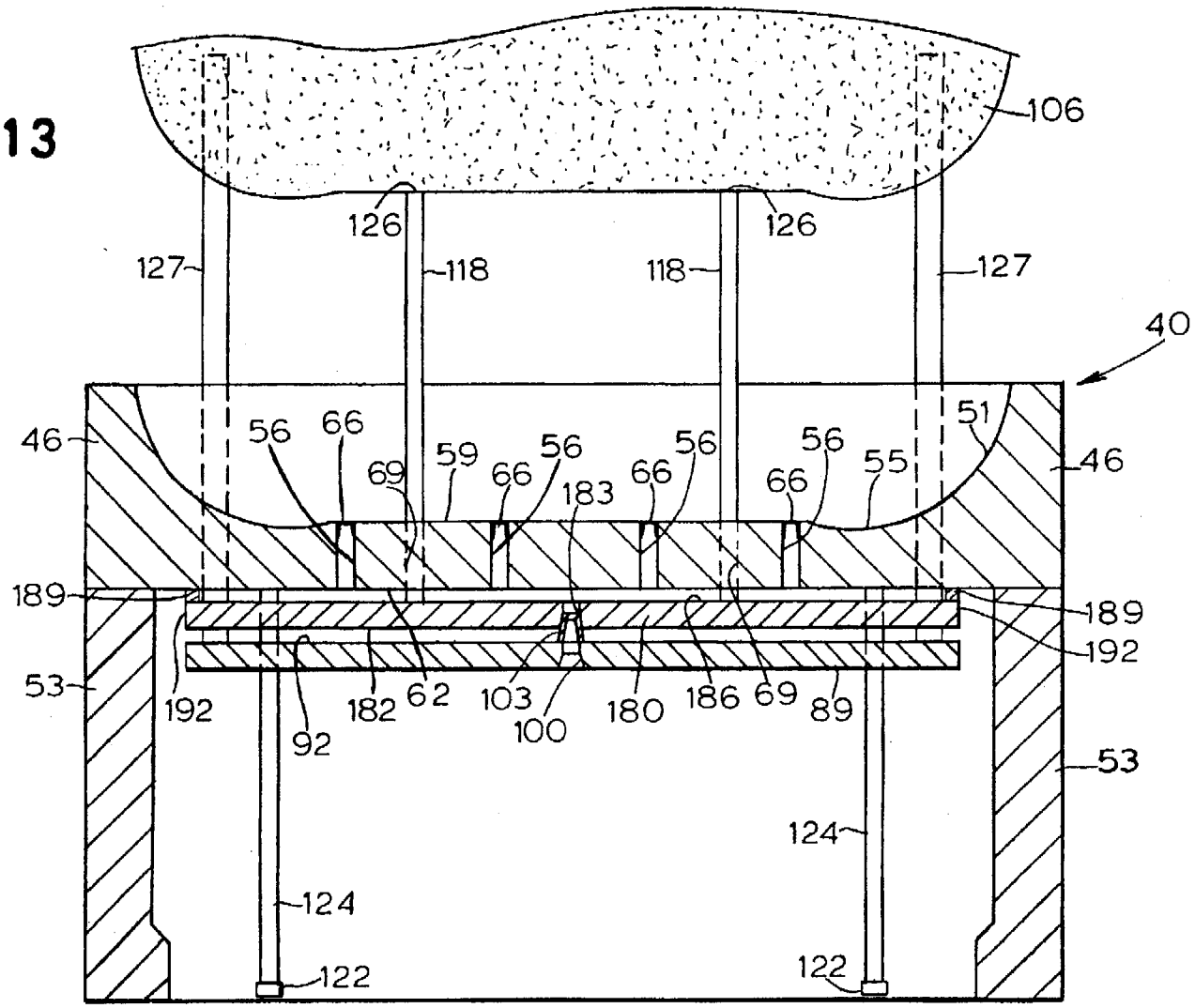

In another embodiment shown in FIGS. 12 and 13, a manifold plate 180 for passing fluid through the vents 66 into the core cavity portion 55 has a bottom surface 182 and a passage 183. The manifold plate 180 is disposed below the drag 46 in the core box 40.

After a core has been produced in the core cavity 51, the core box 40 (without the cope 43) is shuttled to the ejector position located above the ejector plate 89, as described earlier. The ejector plate 89 is then raised from the down position (FIG. 12) by the hydraulic cylinder 109 (FIG. 1). Eventually, as shown in FIG. 13, the nipple 103 of the ejector plate 89 engages in the passage 183 of the manifold plate 180. The ejector plate 89 urges the manifold plate 180 upwardly until a top surface 186 of the manifold plate 180 contacts a marginal lip 189 which extends downwardly from the bottom 62 of the drag 46. Upon making contact, the manifold plate 180 and the lip 189 form a seal which, in turn, forms a fluid manifold 192.

Upon the formation of the fluid manifold 192, cleaning fluid passes through the passage 183 in the manifold plate 180 and then through the vents 66 into the core cavity portion 55, removing sand and dust as in the previous embodiments. The seal between the lip 189 and the manifold plate 180, as well as the proximity of the manifold plate 180 to the vents 66, result in substantial flow of cleaning fluid through the vents 66.

As the ejector plate 89 is subsequently lowered, the seal between the lip 189 and the manifold plate 180 is broken and the plate 180 eventually comes to rest on the heads 122 of the stop pins 124.

Preferably, cleaning fluid is not pumped during the entire raising and lowering cycle of the ejector plate 89. Specifically, pumping is not commenced until the ejector plate 89 is fully raised and the seal between the plate 180 and the lip 189 is formed. Pumping is thereafter terminated prior to lowering of the ejector plate 89 and the plate 180.

Figure 14:
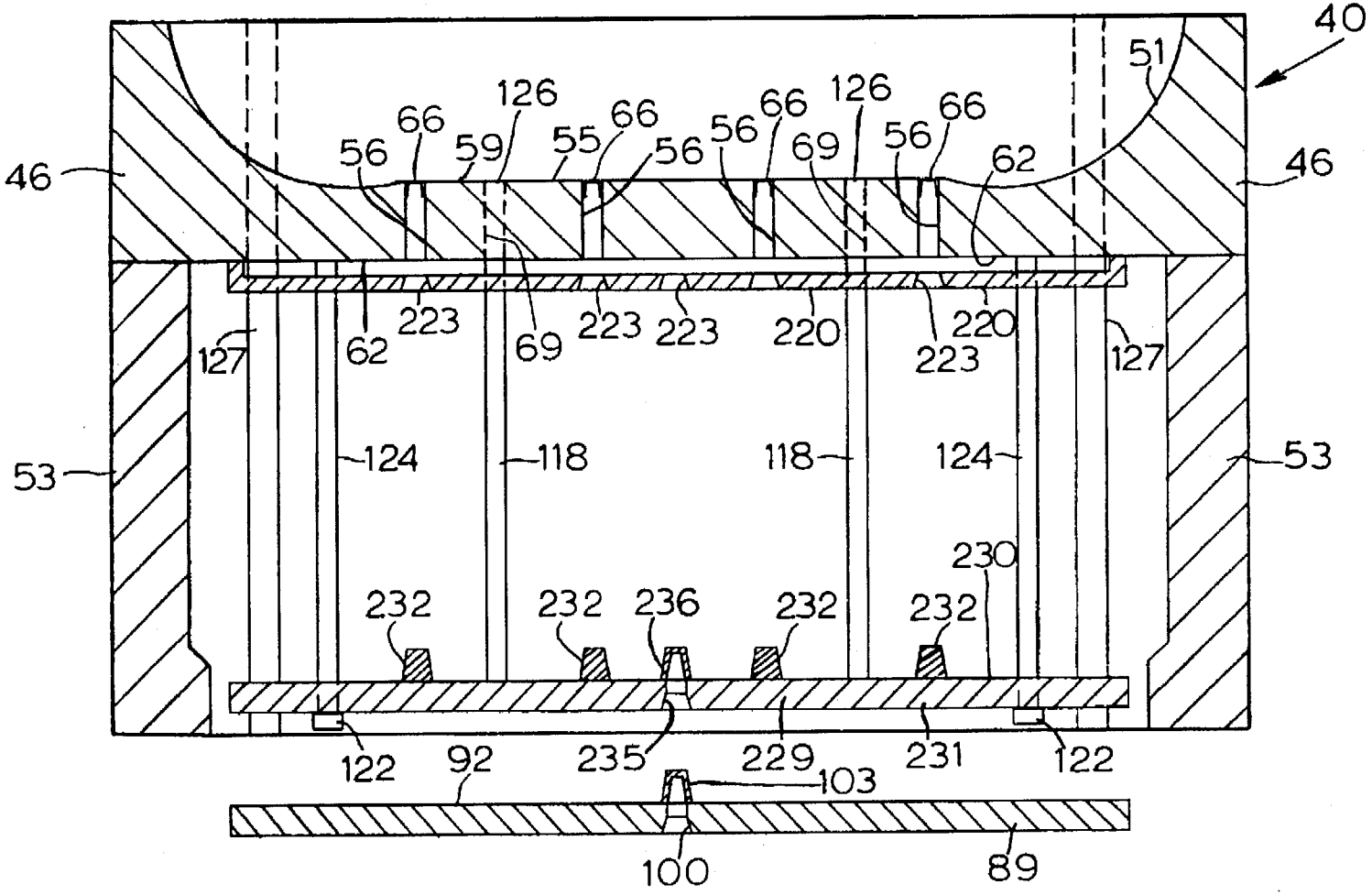
FIGS. 14 and 15 comprise views similar to FIGS. 13, 6 and 7, respectively, of a sixth embodiment of the present invention.
Figure 15:
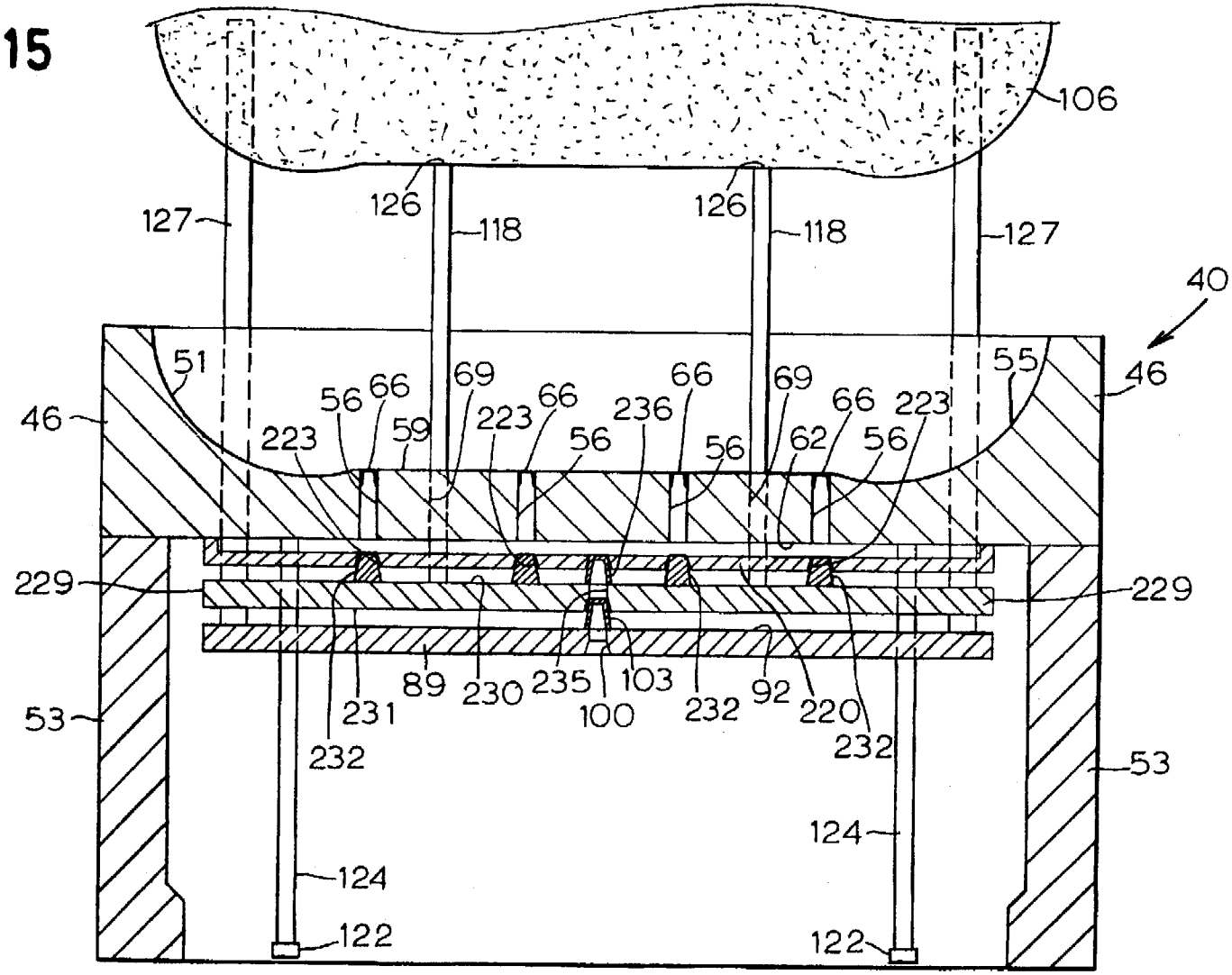

In another embodiment, shown in FIGS. 14 and 15, a fluid manifold 220 having a plurality of ports 223 is attached by any suitable means to the bottom 62 of the drag 46 for passing fluid through the vents 66 into the core cavity portion 55. The ports 223 allow sand passing through the passages 56 during operation to escape from the manifold 220. A plug plate 229 having a top surface 230, a bottom surface 231, and a plurality of plugs 232 is disposed in the core box 40 below the fluid manifold 220. The plugs 232 face upwardly and the positions thereof correspond to the positions of the ports 223 in the fluid manifold 220. The plug plate 229 has a passage 235 from the bottom surface 231 to the top surface 230. A hollow plug 236 is attached by any suitable means to the plug plate 229 coaxially with the passage 235.

As the ejector plate 89 is raised, the nipple 103 of the ejector plate 89 eventually engages in the passage 235 of the plug plate 229. The ejector plate 89 thereafter urges the plug plate 229 upwardly until the plugs 232 of the plug plate 229 engage in the ports 223 of the fluid manifold 220, as shown in FIG. 15.

Fluid passes through the passage 235 in the plug plate 229, through the hollow plug 236 and into the fluid manifold 220. Once in the fluid manifold 220, the fluid passes through the vents 66 into the core cavity portion 55, thereby removing sand and dust in the reverse direction. When engaged in the ports 223 of the fluid manifold 220, the plugs 232 prevent fluid from flowing downwardly through the ports 223.

During lowering of the ejector plate 89, the ejector plate 89 and the plug plate 229 separate. The downward movement of the plug plate 229 is stopped when the bottom surface 231 of the plug plate 229 contacts the heads 122 of the stop pins 124.

As before, cleaning fluid is preferably not pumped during the entire raising and lowering cycle of the ejector plate 89. For example, one may begin pumping fluid when the ejector plate 89 engages the plug plate 229 and then stop pumping while or before the ejector plate 89 disengages from the plug plate 229. If the cleaning fluid comprises solvent, it is preferred that the cleaning fluid only be pumped after the core has been raised above the surface 59 of the drag 46. Thus, one may alternatively begin to pump fluid when the plugs 232 of the plug plate 229 engage the ports 223 in the fluid manifold 220 and then stop pumping fluid when the plugs 232 disengage from the ports 223.

Figure 16:
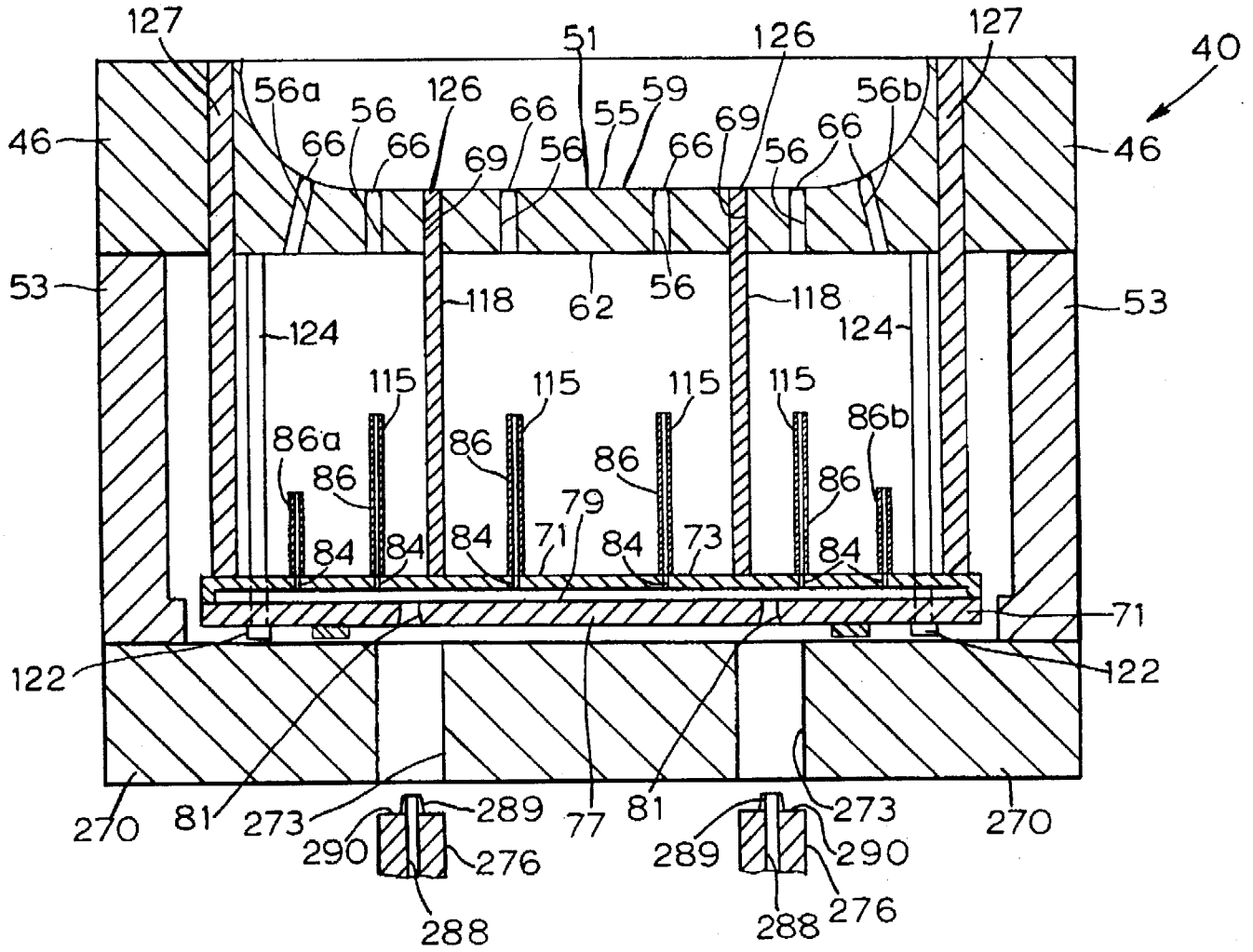
FIGS. 16 and 17 comprise views similar to FIGS. 6 and 7, respectively, of a seventh embodiment of the present invention.
Figure 17:
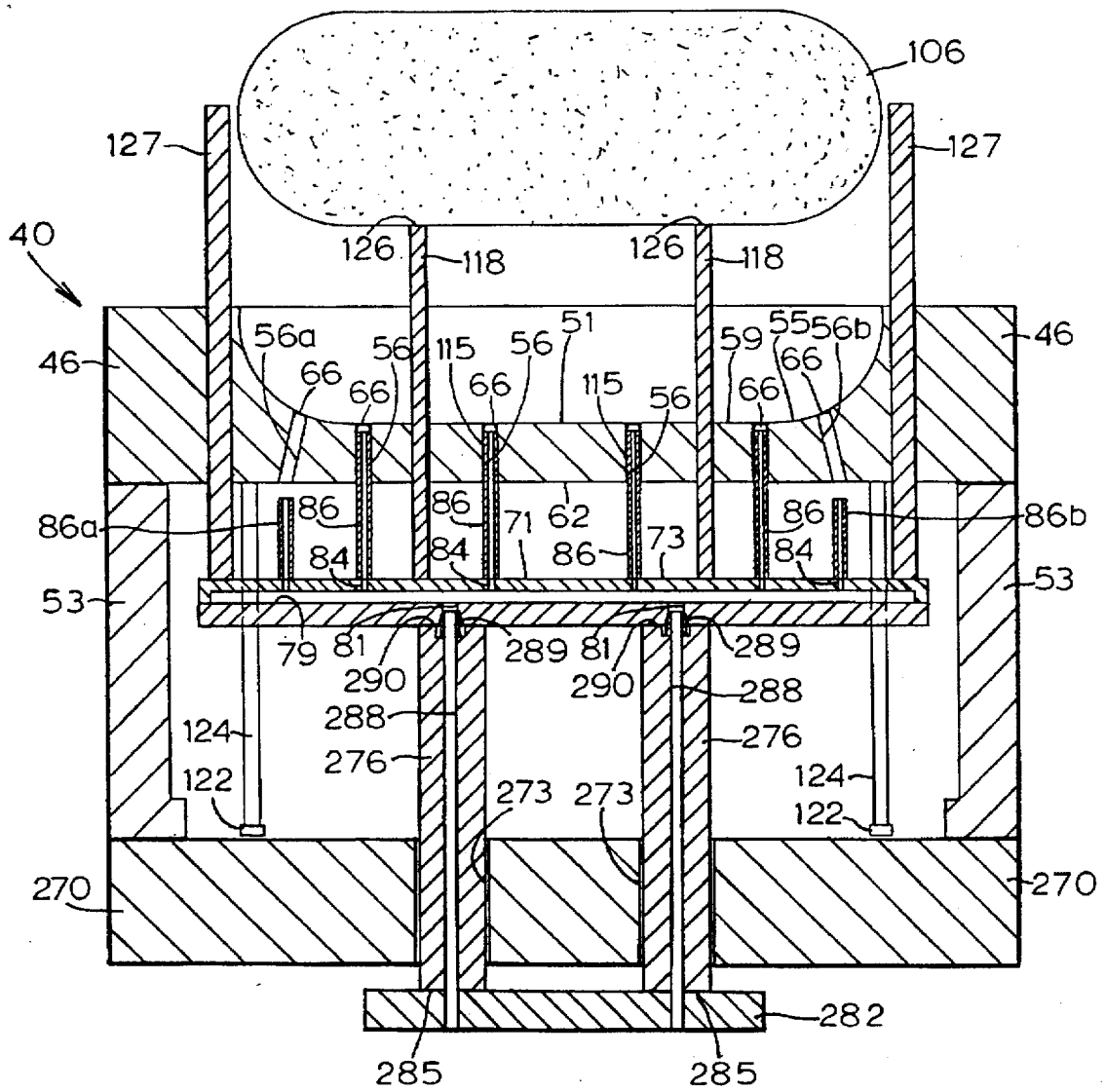

An alternative ejection mechanism may be used in conjunction with some of the embodiments discussed above and is shown in FIGS. 16 and 17 as being employed with the embodiment of FIGS. 6 and 7. Using the alternative ejection mechanism, cleaning of the vents 66 and ejection of the cores 106 may be performed without shuttling the core box 40 into ejector position. In an embodiment including such an ejection mechanism, a ram plate 270 is disposed below the core box 40 and has passages 273 for accommodating a plurality of stationary ejector rods 276. An ejector plate 282 (FIG. 17) is attached by any suitable means to bottom ends 285 of the ejector rods 276. Fluid passages 288 extend downwardly from nipples 289 attached to top ends 290 of the ejector rods 276 through the ejector plate 282.

During ejection of cores, the ram plate 270 and the drag 46 are lowered by the ram 29 relative to the ejector rods 276 while the air compressor 112 pumps fluid through the fluid passages 288. Eventually, the nipples 289 at the top ends 290 of the ejector rods 276 engage inlets 81 in the fluid manifold 71. Further motion of the manifold 71, and thus the core in the cavity 55 is prevented. As the plate 270 and the drag 46 continue to move downwardly, the core is exposed for pick-off. At any appropriate time during the above sequence, cleaning fluid may be pumped through the passages 288 into the manifold 71 and thence to the vents 66 as described in connection with the embodiments discussed earlier.

If desired, rather than exposing the core for pick-off by lowering the drag 46 relative thereto, the core may instead be lifted by moving the ejector rods 276 (and thus the manifold 71, the pins 118 and the core) upwardly relative to the drag 46.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A core box, comprising a core box portion having a cavity therein and a vent in fluid communication with the cavity;

a plurality of ejector members extending into the core box portion; and means coupled to the ejector members for passing a fluid through the vent into the cavity.

2. The core box of claim 1, wherein the passing means comprises a movable integral fluid manifold having an upper portion which carries the ejector members.

3. The core box of claim 1, wherein the passing means comprises a manifold plate movable into engagement with a manifold seal carried by the core box portion.

4. The core box of claim 1, wherein the passing means comprises a fluid manifold carried by the core box portion and means movable into engagement with the fluid manifold for distributing fluid thereto.

5. The core box of claim 4, wherein the distributing means comprises a plug plate carrying the ejector members and having a plurality of plugs engageable with ports in the fluid manifold and wherein one of the plugs includes a passage therethrough from a fluid inlet to a fluid outlet.

6. The core box of claim 1, wherein the passing means comprises a manifold cap member which carries the ejector members and is adapted to be engaged by an ejector plate to form a fluid manifold.

7. A core making machine, comprising:

a core box comprising a drag having a bottom portion, a core cavity portion defined by the drag, and a vent disposed in the drag in fluid communication with the core cavity portion; and an ejector member disposed below the drag and having a passage for passing fluid through the vent.

8. The core making machine of claim 7, wherein the core box further comprises a movable integral fluid manifold disposed above the ejector member and having ejector pins extending into the drag.

9. The core making machine of claim 8, wherein the movable integral fluid manifold has a plurality of apertures and wherein a tube extends toward the vent and is in fluid communication with at least one of the apertures.

10. The core making machine of claim 9, wherein the tube extends into the drag when a core is being ejected from the drag.

11. The core making machine of claim 7, wherein the core box further comprises:

a movable manifold plate disposed above the ejector member, wherein the manifold plate has a passage for passing fluid and has ejector pins extending into the drag; and a lip extending from the bottom portion of the drag.

12. The core making machine of claim 7, wherein the core box further comprises:

a movable plug plate disposed above the ejector member and having a plurality of plugs;

a fluid manifold comprising a lip fixed to the bottom portion of the drag and a plate fixed to the lip opposite the bottom portion of the drag and having a plurality of apertures;

each of the plurality of apertures is vertically aligned with one of the plugs on the plug plate; and one of the plugs is aligned with a passage in the plug plate and has a passage for passing fluid.

13. The core making machine of claim 7, wherein the core box further comprises a manifold cap disposed above the ejector member comprising:

a plate having a bottom portion, a top portion, and a plurality of apertures;

a lip extending from the bottom portion of the plate; and a plurality of ejector pins extending from the top portion of the plate into the drag.

14. The core making machine of claim 13, wherein the plate of the manifold cap further comprises a tube extending above one of the apertures and in fluid communication with the aperture.

15. A method of cleaning a core box vent in a core box comprising an ejector member and a drag, the method comprising the steps of:

providing a passage for passing fluid through the ejector member; and passing fluid through the ejector member passage and the vent during ejection of a core.

16. The method of claim 15, further comprising the steps of:

a) providing a manifold cap having a passage and an ejector pin;

b) moving the ejector member toward the manifold cap;

c) engaging the ejector member with the manifold cap to form a fluid manifold; and d) lowering the ejector member and the manifold cap after ejecting the core.

17. The method of claim 15, further comprising the steps of:

a) providing an integral fluid manifold having an inlet and an ejector pin;

b) moving the ejector member toward the integral fluid manifold;

c) engaging the ejector member with the inlet of the integral fluid manifold; and d) lowering the ejector member and the integral fluid manifold after ejecting the core.

18. The method of claim 15, further comprising the steps of:

a) providing a lip on a bottom portion of the drag and a plate disposed below the lip and having a passage and an ejector pin;

b) moving the ejector member toward the lip;

c) engaging the ejector member with the plate;

d) forming a manifold between the plate and the lip; and e) lowering the ejector member and the plate after ejecting the core.

19. The method of claim 15, further comprising the steps of:

a) providing a plate having a plurality of orifices, wherein the plate is attached to a lip extending from the bottom of the drag;

b) providing a plug plate disposed below the plate and having a plurality of plugs and an ejector pin;

c) moving the ejector member toward the plug plate;

d) engaging the ejector member with the plug plate;

e) engaging the plug plate with the plate attached to the lip; and f) lowering the ejector member and the plug plate after ejecting the core.

20. The method of claim 15, wherein core sand is deposited into a core box cavity disposed between a cope and the drag to form the core and core sand flows into the vent in a first direction during formation of the core and wherein the step of passing fluid includes the step of directing fluid through the vent in a second direction opposite the first direction.

* * * * *